United States Patent [19]

Guenther et al.

[11] 4,346,876

[45] Aug. 31, 1982

[54] VACUUM DOCUMENT FEEDER

[75] Inventors: Kenneth L. Guenther, Park Ridge; Jerry J. Kosner, Jr., Oakbrook Terrace; Rolf B. Erikson, Highland Park; Edward H. Zemke, Chicago, all of Ill.

[73] Assignee: Bell & Howell Company, Chicago, Ill.

[21] Appl. No.: 148,068

[22] Filed: May 12, 1980

[51] Int. Cl.[3] ..... B65H 3/08; B65H 1/02

[52] U.S. Cl. ..... 271/11; 271/30 A; 271/95; 271/104; 271/107

[58] Field of Search ..... 271/30 A, 107, 11, 14, 271/149, 150, 12, 13, 15, 31, 104, 106, 108, 5, 6, 20, 103, 100, 90, 95; 414/330; 221/211

[56] References Cited

U.S. PATENT DOCUMENTS

| | | | |
|---|---|---|---|
| 1,625,085 | 4/1927 | Leach | 271/11 UX |
| 2,761,680 | 9/1956 | Lens | 271/107 X |
| 3,053,530 | 9/1962 | Peeters | 271/30 A |
| 3,079,147 | 2/1963 | Childs | 271/12 X |
| 3,313,537 | 4/1967 | Garwood | 271/30 A |
| 3,893,392 | 7/1975 | Brenn et al. | 271/12 X |

*Primary Examiner*—Bruce H. Stoner, Jr.
*Attorney, Agent, or Firm*—Alan B. Samlan

[57] ABSTRACT

A new and improved vacuum document feeder provides a vacuum cup support mechanism which follows a somewhat crescent-shaped coupler curve that eliminated the vacuum cup wear-producing disadvantages of the prior art and provides for increased feeding rates. A four-bar system moves a table over the somewhat crescent-shaped coupler curve, while at all times holding an edge of the table parallel to the documents. At least one vacuum cup is pivotally mounted on the table, to sweep over an angle which accommodates leaning documents. Cams on a drive pulley associated with the transport system coordinates the table movement with both the pivoting and vacuumizing of the cups.

10 Claims, 18 Drawing Figures

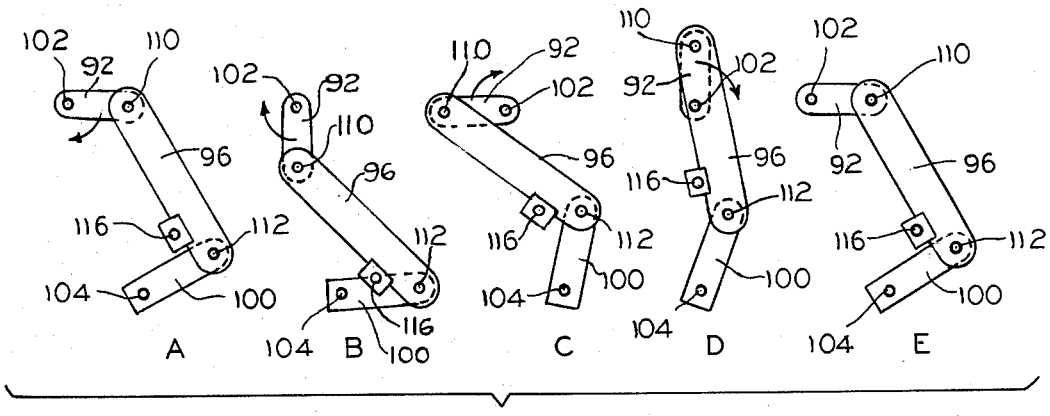
FIG.9
FIG.12
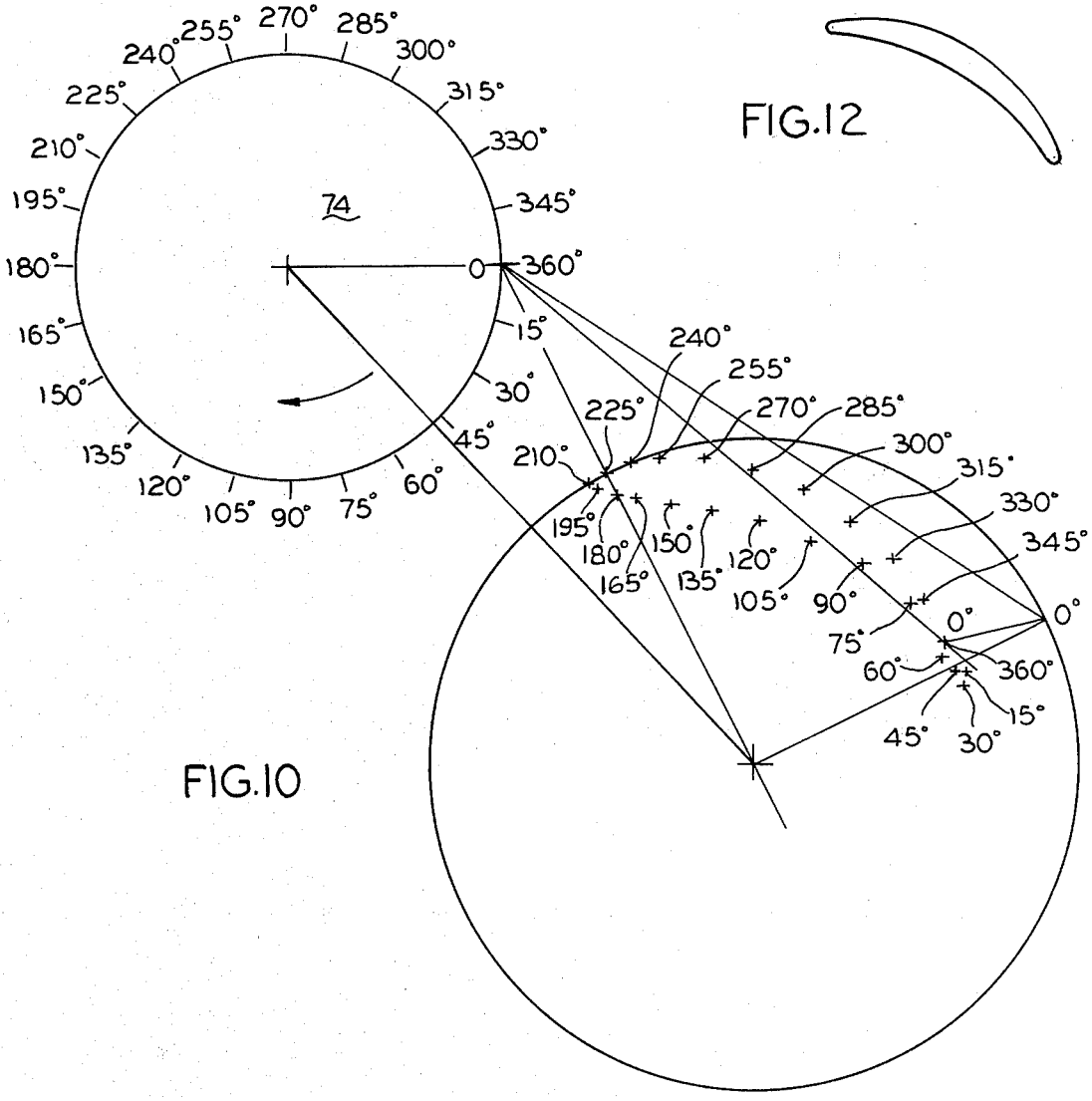
FIG.10

VACUUM DOCUMENT FEEDER

BACKGROUND AND SUMMARY OF THE INVENTION

This invention relates to document feeder and delivery systems and, more particularly, to vacuum systems which are adapted to tolerate a greater degree of document misalignment, document size intermix, and surface non-uniformity, than was heretofore possible and to reduce the wear and tear on vacuum cups used to pick up the documents.

The inventive document feeder and delivery system uses vacuum cups designed to pick up one document at a time and to deliver it to a document transport and processing machine. A horizontal stack of vertically oriented envelopes is exemplary of the arrangements and types of documents which are likely to be handled by the inventive document feeder. A postage scale and metering machine is exemplary of a document-processing machine which is likely to be fed by the inventive document feeder system. However, the invention is not necessarily limited to feeding envelopes or to any other specific document form.

The envelopes are stacked, and the stack is placed horizontally on a belt. The belt moves the envelopes into the reach of the vacuum cups. The vacuum cups pivot on a circular arc toward the exposed end of the stack of envelopes. The pivot point of the vacuum cup arc is located above the envelope and parallel to envelope surface. On each cycle, the vacuum cups grasp one of the envelopes and then positions it within the grasp of a document transport system. The transport system carries the envelope away while the vacuum cups go back to get the next envelope.

In prior feeding systems, the vacuum cups would withdraw an envelope from the stack, remove the vacuum, and drop the envelope onto a second moving belt located below the stack. Furthermore, no provision was made for envelopes presented at a skewed angle. This type of system had four common problems. The envelopes drop from the cups because they are accelerated by the force of gravity. The time required for the envelope to fall, limits the cycle speed of the machine. At higher speeds, the vacuum cups drop an envelope and return fast enough to impact the same envelope. This impact abrades the cups and shortens their life. The envelopes are not positively positioned into the document transport and at times hang up on the second moving belt and never reach the transport system. Finally, a vacuum cup depends, at least in part, upon its being seated squarely upon the envelope. Therefore, if the envelope is presented to the cups at a skewed angle, the vacuum may not be properly formed. This increases the expense and complexity of the envelope registration system.

Accordingly, an object of the invention is to provide new and improved vacuum envelope feeders. Here, an object is to provide a vacuum cup support mechanism which follows a path that eliminates the above-stated disadvantages. In this connection, an object is to provide a low-cost mechanism which accomplishes the foregoing and other objects, in new and improved ways.

An additional object is to provide a document feeder to reliably separate and feed an intermix of media varying in length, height, and thickness. It is also an object to provide vacuum cup path that traces a route such that the cup clears the fed document on its return stroke to pick off the next document. A further object is to provide a feeder which presents documents to the vacuum cups in a constant orientation and with minimum inter-document force.

In keeping with an aspect of the invention, the foregoing and other objects are accomplished by a four-bar linkage or lever arm system which moves a table over a specified crescent-shaped coupler curve, while at all times holding an edge of that table parallel to the envelopes. At least one vacuum cup is pivotally mounted on the table to tilt at an angle which is large enough to accommodate poorly registered envelopes. Cams on a drive wheel associated with the four-bar linkage coordinate the table movement with both the pivoting and the vacuumizing of the cups.

BRIEF DESCRIPTION OF THE DRAWINGS

A preferred embodiment of this invention is seen in the attached drawings wherein:

FIG. 9 shows five stop-motion positions of a pair of bars taken from the four-bar or lever arm of FIG. 8;

FIG. 10 graphically illustrates the somewhat crescent-shaped coupler curve followed by the table of FIG. 6 as it is transported by the four-bar system of FIG. 8.

FIG. 12 illustrates an alternative coupler curve path followed by the table of FIG. 6.

DETAILED DESCRIPTION OF THE PREFERRED EMBODIMENT

Figure 1:
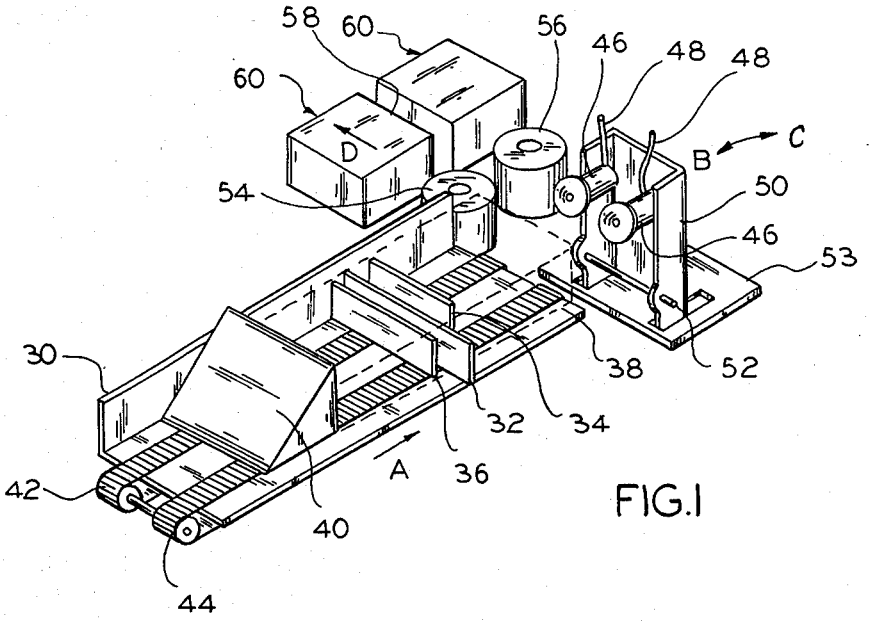
FIG. 1 is a perspective view of an exemplary machine which might use the invention.

The invention will find use anytime that it is desirable to separate documents, one at a time, from a horizontally-oriented stack of documents. Nevertheless, for convenience of description and to present a concrete example, the invention is shown in FIG. 1, in association with a machine for handling mailing envelopes.

In greater detail, documents in the form of envelopes, or the like, are vertically placed in a horizontal stack on a movable belt 42, 44 cycled on and off with a photodetector depending on feed speeds. The stack is aligned at one end against a vertical fence 30 (FIG. 1). These envelopes may be any size; therefore, FIG. 1 shows, by way of example, a large envelope 32, a small envelope 34 and a middle-sized envelope 36. The entire horizontal stack of envelopes is represented by a dashed line rectangular configuration 38. A suitable support or back stop 40 resting on the belts 42, 44 support the envelopes in their vertical position. Any convenient number of conveyor belts 42, 44 moves the stack of envelopes in direction A. Each of these belts has vertically upstanding teeth to engage the bottom edges of every third or fourth envelope, for example.

These teeth act to retain the stack, preventing the bottom edge of the documents from sliding forward, and maintaining stack integrity without any inter-document force (other than the component of force due to the weight of the document).

A pivotally supported pair of vacuum cups 46 are positioned to cyclically swing over an arc and pick up the envelopes, one at a time. The vacuum is supplied to these cups via any suitable tubes 48. The cups 46 are mounted on the free ends of pivoted brackets 50 to swing back and forth over an arc, in directions B-C, about the axis 52, which is fixedly mounted on a moving table 53.

A pair of nip rollers 54, 56 are positioned near the vacuum cups at a location where the rollers may carry away the envelopes after they are released from the vacuum cup. The nip rollers 54, 56 propel the envelope in the direction D and into a slot 58 of any suitable document-processing machine 60. The exact nature of the machine 60 is irrelevant to the invention. It might be thought of as a scale and postage meter combination which weighs the envelope and then applies the correct postage thereto.

Figure 2:
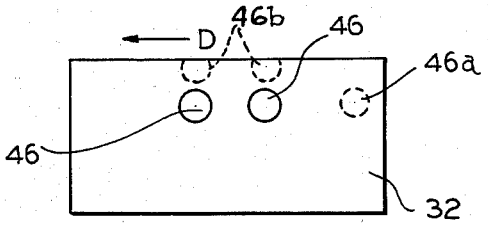
FIG. 2 schematically illustrates vacuum cup document feed problems which have been encountered in the past.
Figure 3:
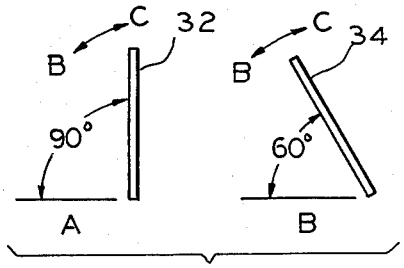
FIG. 3 schematically illustrates an alternate vacuum cup document feed problem which has been encountered in the past.

Some of the problems encountered heretofore in vacuum document feed machines, such as this, are explained with the help of FIGS. 2, 3. In greater detail, FIG. 2 shows the envelope 32 as being lifted by the vacuum cups 46 shown by solid line circles for transportation into the nip of the rollers 54, 56. As the envelope goes flying off the vacuum cups in direction D, it may still be in the path of the vacuum cups when they are moved in for the next document pickup. Thus, at least one of the vacuum cups 46*a* (shown by a dashed line circle) may impact and/or engage an end of the envelope 32 which was just released. This contact with the same envelope causes undesired effects. First, the nip rollers 54, 56 will snatch the envelope off the vacuum cup at position 46*a* and abrade the cup, thereby shortening its life. Second, the vacuum cup might have a sufficient force on envelope 32 to change its alignment and thereby deflect or damage it or cause it to jam in the nip. Third, the vacuum cups can complete the cycle with a second envelope which could cause the two envelopes to attempt a simultaneous feed which causes undesireable double feed or jams the entire system.

Another problem encountered in a prior document feed machine is further illustrated in FIG. 2. This problem relates to a prior feeding system whereby the envelopes are withdrawn from the stack and dropped onto a conveyor or into a hopper. As the envelope is dropped, it may still be in the path of the vacuum cups as they return to pick up the next document. Thus, both cups 46*b* (shown by the dashed line circle) may impact the top edge of the envelope which was just released. This results in the same undesired effects as listed above.

FIG. 3 shows that the documents do not always stand perfectly upright and vertically in the stack 38 (FIG. 1). For example, the envelope 32 has been drawn as standing perpendicularly with respect to the belts 42, 44, while envelope 34 has been drawn as leaning at 60 degrees. If an envelope does not rest squarely upon the periphery of the vacuum cup, the vacuum might not form properly. Therefore, it sometimes has heretofore been difficult to pick up badly registered documents.

According to an aspect of the invention, these and other problems are solved by providing a table which is mounted on a mechanical transport system which follows a somewhat crescent-shaped coupler curve, while continuously holding a pair of vacuum cups in a plane which is parallel to the documents that are being fed into the device. The vacuum cups are mounted on the swinging ends of pivotal arms. The arms and, therefore, the cups swing over an arc which accommodates leaning documents, as disclosed in FIG. 3.

Figure 4:
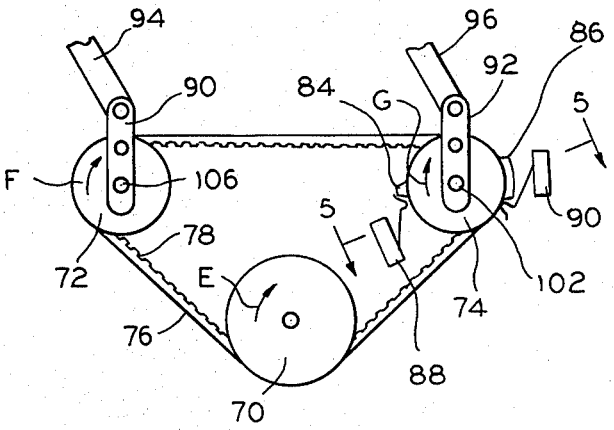
FIG. 4 is a plan view which shows the power drive system and associated input arms and initial parts of a four-bar linkage or lever arm system.
Figure 5:
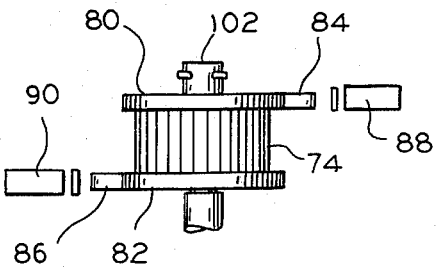
FIG. 5 is a vertical elevation of one timing pulley control cam taken along line 5—5 of FIG. 4.

One preferred embodiment of the invention is shown and explained in the remaining FIGS. 4–18. In greater detail, the power train for the vacuum document mechanism is shown in FIG. 4 and driven by a suitable motor (not shown) coupled to a drive timing pulley 70. This pulley is, in turn, coupled to two driven timing pulleys 72, 74 by a belt 76 having teeth, as shown at 78, for example. The peripheries of the wheels 70–74 have suitable teeth for meshing with and being driven by the teeth 78 on the toothed belt 76. Accordingly, as the motor turns the drive timing pulley 70, the two driven timing pulleys 72, 74 turn synchronously, in phase with each other.

The driven timing pulley 74 has upper and lower cams 80, 82 (FIG. 5), each of which is cut with a profile that identifies a phase in the cyclic mechanical movement of table 53. Thus, for example, a profile 84 on cam 80 may control the pivoting of the vacuum cup supporting lever arm 50. A profile 86 may control the application or removal of a vacuum to the vacuum cups 46. A pair of microswitches 88, 90 are positioned at any suitable location to cause the controlled function to occur at desired times in a cycle defined by one complete rotation of the timing pulley 74. These functions are described in FIG. 11, where the angular notations of the horizontal axis refer to incremental stages in one complete 360° revolution of the timing pulley.

Rigidly attached to and rotating with the timing pulleys 72, 74 are two input bars or levers 90, 92 which are pivotally connected to a four-bar system, beginning with the coupler arms 94, 96.

Figure 6:
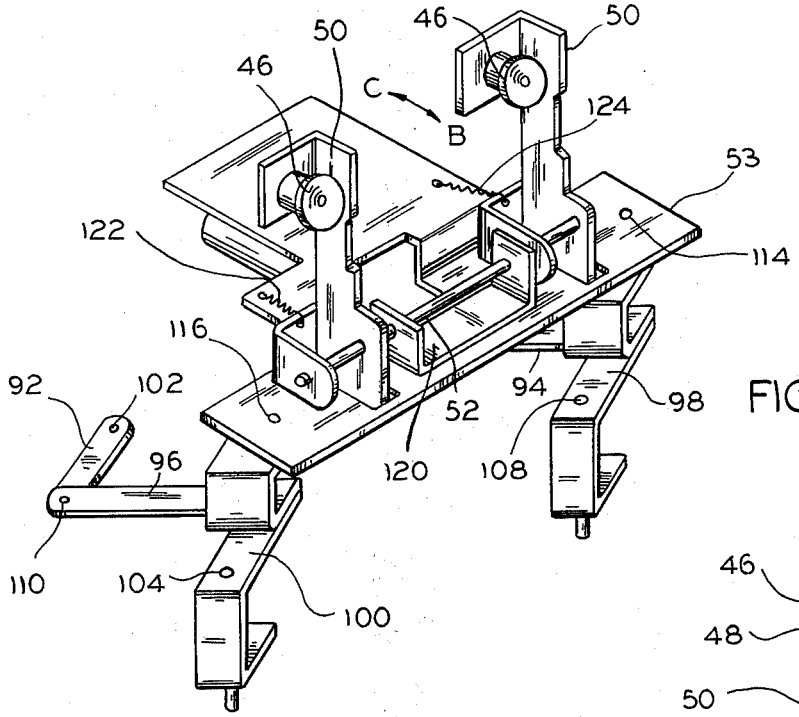
FIG. 6 is a perspective view of a table mounted on and moved by a four-bar system, the table carrying a pair of vacuum cups.
Figure 7:
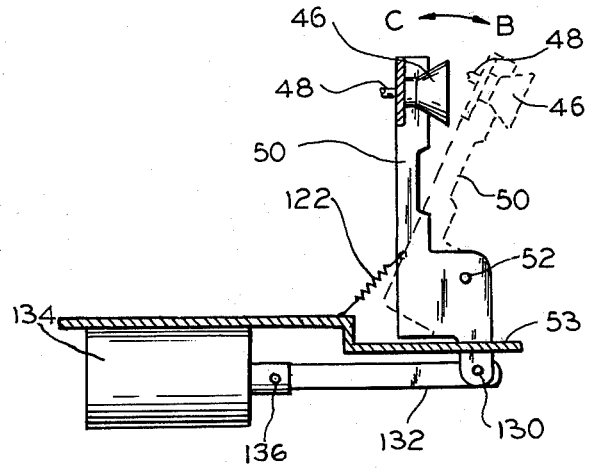
FIG. 7 is a side elevation of the structure seen in FIG. 6, here showing (by dashed lines) a pivoting of the vacuum cups.
Figure 8:
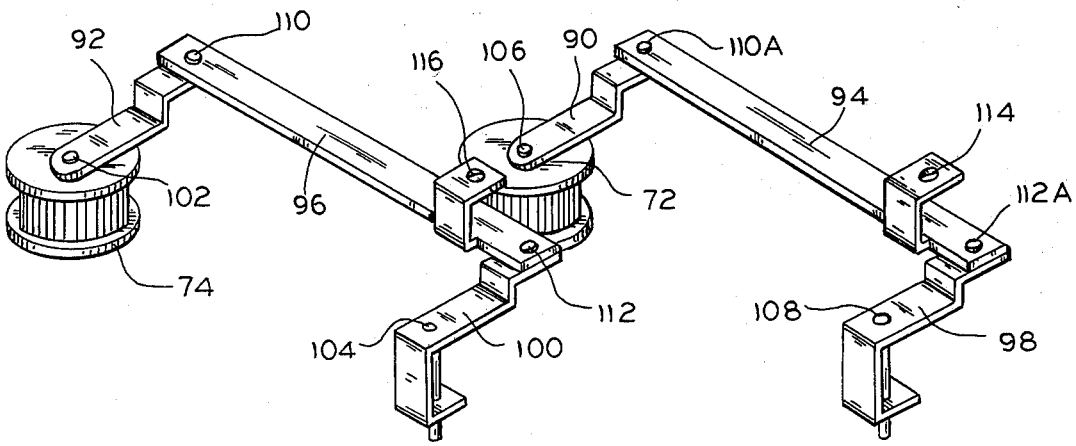
FIG. 8 is a perspective view of the four-bar or lever arm, table support system and two timing pulleys, taken from FIG. 4.

The details of the table 53, vacuum cup supporting pivot arms 50 and the four-bar linkage system are seen in FIGS. 6–8. The specific linkage can be modified to produce a crescent shaped coupler curve which has two cusps, a coupler curve with one cusp and one rounded end, or a coupler curve with two rounded ends, which resembles a banana shape. The preferred embodiment was a coupler curve having one cusp and one rounded end.

In greater detail, the individual links or bars in the four-bar linkage are designated 94, 96, 98, 100. The ground points for the four-bar linkage 92, 96, 100, ground are the axle 102 of the timing pulley 74 and the pivot point 104. Point 104 is formed by a vertical post fixed onto a chassis (not shown). The ground points for the other four-bar linkage 90, 94, 98, ground are the axle 106 of the timing pulley 72, and pivot point 108, also fixed onto the chassis. The opposite ends of bar 96 are pivotally connected to bars 92, 100 at points 110, 112. The opposite ends of bar 94 are pivotally connected in a similar manner at points 110A, 112A.

Each of the bars 94, 96 carries a bearing point or support 114, 116, respectively, for supporting the table 53. This bearing point defines the crescent-shaped coupler curve. The two four-bar linkages 92, 96, 100, ground and 90, 94, 98, ground are identical and are timed such that a line through the bearing points 114, 116 always remains parallel to the end of the stack 38 (FIG. 1) of documents.

A U-shaped bracket 120 (FIG. 6) is screwed, or otherwise secured to or formed in the top of table 53. The vacuum cup supporting pair of pivot arms 50, 50 are pivotally connected to bracket 120 by means of a shaft 52. Thus, the arms 50, 50 are free to swing over an arc B-C and between two positions shown in FIG. 7 by solid and dashed lines, respectively. Documents are picked up during the swing in direction B, toward the dashed line position. Coiled extension 122, 124 normally bias the arms 50 to their rear-most position (i.e., the solid line position (FIG. 7), in direction C).

Beneath the table 53, the lower ends of the arms 50, 50 are interconnected in any suitable means, such as by a U-shaped shackle. A pin 130 (FIG. 7) rotatably joins this interconnection with a longitudinally movable actuator member 132. A solenoid 134 has an associated plunger 136 which is interconnected with actuator member 132. When the solenoid 134 is energized, plunger 136, member 132 and actuator 130 retract to pull the bottom ends of arms 50 which pivots at axis 152 in direction B to the dashed line position. When the solenoid 134 is de-energized, the springs 122, 124 pull the arms 50, 50 back to their upright, solid line position.

By comparing FIGS. 3 and 7, it is seen that the excursion arc of arm 50 is adequate to accommodate documents sitting at a great variety of angles with respect to the top of table 53, ranging from a vertically disposed envelope to a leaning envelope. Once it engages, the vacuum forms and continued arm motion in direction B is not relevant.

The envelope stack is intentionally inclined to a nominal angle as in FIG. 3B. This prevents the envelopes from falling foreward and, considering the teeth on the belts 42, 44 which prevents the bottom from sliding forward, it makes loading more convenient.

The cyclic operation of the four-bar linkage and the somewhat crescent-shaped coupler curve of table 53 should be apparent from a study of FIGS. 9, 10. FIG. 9 shows the articulation of one pair 92, 96, 100 ground, of the four-bar linkage, while the drive wheel makes one complete 360° rotation. The other four-bar linkage 90, 94, 98 ground, has the same articulation, always moving parallel, with the bars shown in FIG. 9. A line through the table-bearing point 114 (FIG. 8) on linkage bars 90, 94, 98, ground, and point 116 on linkage bars 92, 96, 100, ground, is always parallel to lines through the two pairs of ground points 102, 106 and 104, 108. Therefore, the table 53 and the edges of vacuum cups 46 are also parallel to lines through these ground points and the envelopes of stack 38.

The two bearing points 114, 116 follow a somewhat crescent-shaped coupler curve which is seen as a series of "X" marks in FIG. 10. The driven timing pulley 74 is seen in the upper left-hand area of FIG. 10, with every 15° of a full 360° of rotation marked. The table-bearing point 116 is seen in the lower right-hand portion of FIG. 10. As the timing pulley 74 rotates through 0°–30°, the bearing point 116 is pushed forward toward the stack 38 (FIG. 1) of the envelopes. At 30° the bearing point 116 reaches its forward-most position, or cusp, where the vacuum cups pick up the forward-most envelope of the stack.

When the timing pulley 74 moves through the arc (30°–45°), the vacuum cups move away from the stack, in a direction almost perpendicular to the stack 38.

During the next leg of the excursion, 45°–210°, the table 53, carrying vacuum cups 46, gradually changes direction, from initially substantially perpendicular to the stack 38 to substantially parallel to the stack 38 at 180°, and transports the document directly into the nip of the rollers 54–56.

In the leg of the excursion from 210° to about 270°, the table 53 carrying vacuum cups 46, is backing away from the document, which is then being whisked through the nip rollers 54, 56, and at the same time is returning towards home (0°) position.

Thus, the vacuum cups are too far removed from the document to impact it in the manner suggested by location 46*a* (FIG. 2). Accordingly, the document is positively placed in the nip of rollers 54, 56 and does not rely on gravity to transport the document into the transport section.

During the leg of the excursion between 270° and 360°, the table 53 carries the vacuum cups 46 back to the starting point, from which they move on to pick up the next document. The important thing to note is that, in the excursion leg from about 210° to about 270°, the vacuum cups are actually backing away from the document which is then in the nip of rollers 54, 56.

Figure 11:
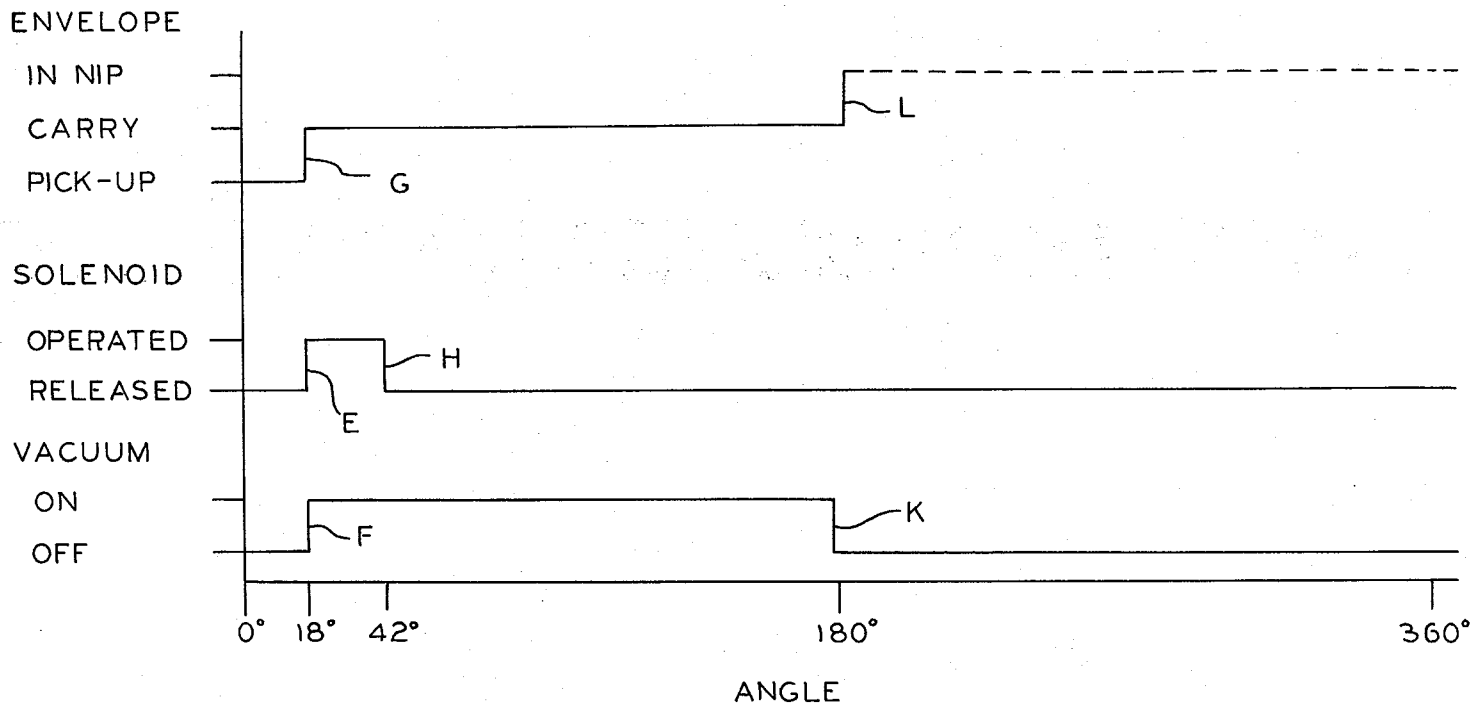
FIG. 11 is a timing diagram which explains the control sequence of the various systems in the inventive structure.

FIG. 11 shows how the cams 84, 86 control the document pickup and vacuum cycles. More particularly, the solenoid 134 (FIG. 7) is energized at 18° rotation of the timing pulley 74, the solenoid 134 (FIG. 7) is energized (point E, FIG. 11) to pull plunger 136 (FIG. 7), and link 132, thereby swinging arm 50 in direction B toward the dashed line position. At the same time (point F, FIG. 11), a vacuum is applied to the cups 46. Thus, at point G (18°), the document is picked up from the stack 38 and pulled over a strip ridge 138 mounted on frame 140. The action of the belts 42, 44, with their vertically upstanding teeth, urges the bottom edge of the stack 38 against the strip ridge 138, thus fanning the stack at the top and rendering more reliable separation (See FIG. 18). The vacuum cups 46, on pivot arms 50, are pivoted, forward to contact the first envelope of the stack, 38. Because the stack 38 has been fanned, air behind the first envelope pushes the envelope against the vacuum cup 46 due to the vacuum within the cup area. As the vacuum cup 46 pivots with pivot arm 50 back to the vertical position, the envelope being held against the vacuum cups 46 is stripped from the stack 38. The motion is such that the envelope is simultaneously lifted and pulled back from the remaining envelopes in the stack 38. As this occurs, the bottom edge of the document is snapped over the strip ridge 138, while the next document is held back by the strip ridge 138.

Figure 13:
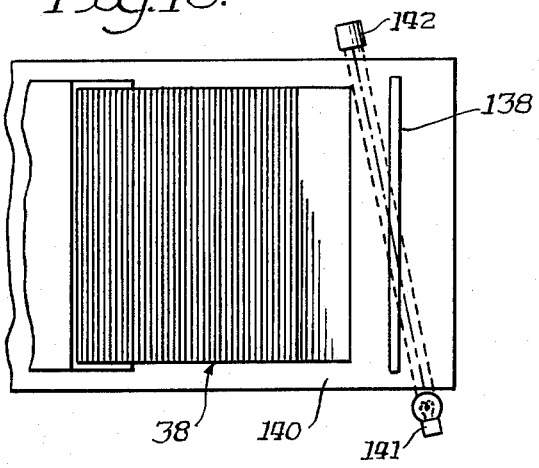
FIG. 13 schematically illustrates a photo cell used to activate a belt drive system to move the stack forward.
Figure 15:
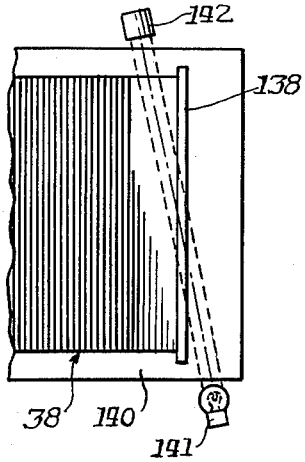
FIG. 15 schematically illustrates the system of FIG. 13 in the "off" position.
Figure 14:
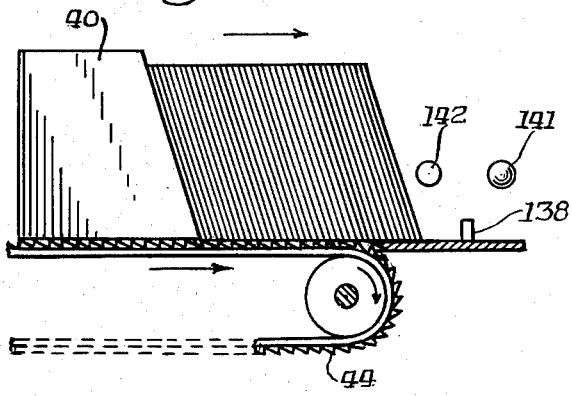
FIG. 14 is a side view of the schematic of FIG. 13.
Figure 16:
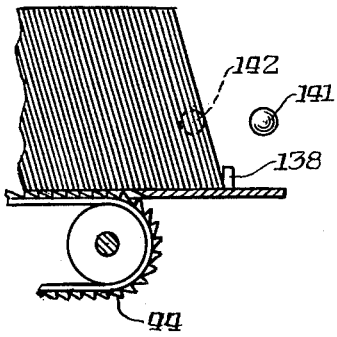
FIG. 16 is a side view of the schematic of FIG. 15.
Figure 17:
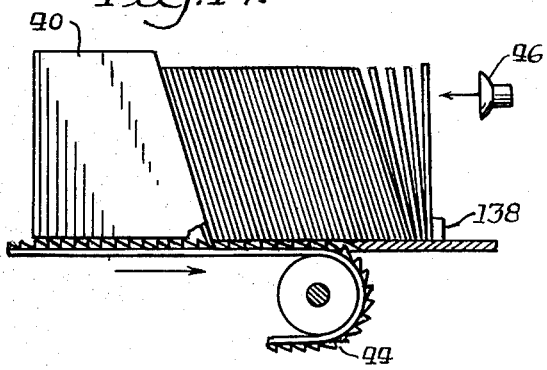
FIG. 17 schematically illustrates the stack feed belt moving the documents towards the sucker cups and separating the tops of the documents for easy removal.
Figure 18:
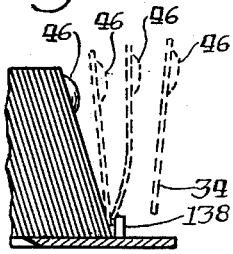
FIG. 18 schematically illustrates the removal of a document at four time frames.

The movement of the belts 42, 44 is controlled by a non-contact sensor, such as a lamp 141 and photo cell 142. In FIG. 13, the stack 38 is moved forward via the belts 42, 44 which are driven by a motor (not illustrated) when envelopes are removed from the front of the stack. The photo cell 142 detects the absence of envelopes, turning the motor on to drive belts 42, 44 forward as illustrated in FIGS. 13 and 13*a*. Similarly the motor is turned off when envelopes are present, such as illustrated in FIGS. 14 and 14*a*. The front of the stack, thus, present substantially a constant envelope surface to the vacuum cups.

When the driven timing pulley 74 reaches 42° (point H, FIG. 11), the solenoid 134 (FIG. 7) is de-energized and springs 122, 124 pull arms 50, vacuum cups 46 and envelope 30 back to the upright solid line position for transport to the nip rollers.

During the rotational segment 18°–180° (points F to K, FIG. 11), the vacuum is held in cups 46. Then, the vacuum is cut off at point K. An instant later (point L), the document is picked up by the nip of rollers 54, 56. The document travel distance between times K and L is negligible, easily within an inertial travel period for even the lightest of documents. Nevertheless, the rollers 54, 56 do not snatch the document off the vacuum cups at a time when there is a high vacuum in them. This reduces wear and abrasion of the vacuum cups. As vacuum is turned off by a vacuum valve (not illustrated), the vacuum in the cups is simultaneously vented to atmospheric pressure.

The advantages of the invention should now be apparent. During the time when the solenoid is operated (points E-H, FIG. 11), the table and vacuum cups travel over a distance 18°–42°. From FIG. 10, this distance is laterally negligible, to a degree of practical non-existence. Hence, the vacuum cups are not dragged sideways in any wear-inducing motion. At the time when pickup occurs, the vacuum cups are swinging over arc B-C (FIGS. 3, 7), to accommodate leaning documents. At the time (point L, FIG. 11) when the document is snatched by the nip of rollers 54, 56, the vacuum has already been vented to atmosphere (point K). Immediately after the vacuum is dropped (point K), the cups back away from the document in order not to interfere with its excursion through the nip rollers 54, 56.

Those who are skilled in the art will readily perceive how to modify the system. Therefore, the appended claims are to be construed to cover all equivalent structures which fall within the true scope and spirit of the invention.

What is claimed is:

1. A vacuum document feeder system comprising:

drive means to provide power to a four bar mechanism having at least one bearing point, said drive means causing said bearing point to cyclically rotate over a somewhat crescent shaped coupler curve, support means connected to said bearing point, at least one document seizing vacuum cup means pivotally mounted on the support means whereby said vacuum cup means cyclically follows said somewhat crescent shaped coupler curve, means for delivering vertically oriented documents from a horizontal stack of documents to a document pick-up location at an end of the horizontal stack, said vacuum cup means pivoting from a substantially vertical orientation to an angle relative to said vertical orientation to accomodate documents leaning at said angle relative to said vertical orientation, document transport means for moving documents in a direction away from said vacuum cup means, said document transport means having a nip for receiving documents seized and removed from said horizontal stack by said vacuum cup means, said support means cyclically approaching and leaving said stack in substantially horizontal, perpendicular directions relative to said vertically oriented documents, the document at the end of the horizontal stack of documents being seized by said vacuum cup means when said support means is at substantially one end of said crescent shaped coupler curve, said vacuum cup means with said documents approaching said nip in a direction parallel to the direction of travel of said documents when placed in said nip, and cam means associated with the support means for coordinating the bearing point movement with both the pivoting and vacuumizing of the cup means.

2. The vacuum document feed system of claim 1 wherein said crescent-shaped coupler curve has at least one cup thereof rounded.

3. The vacuum document feeder system of claim 2 wherein the power drive means comprises a pair of sychronously driven pulleys, input bar means on each of said driven pulleys, wherein there are two of said four bar mechanisms comprising a series of pivotally interconnected bars, each of said series extending from said input bar means to a ground point about which one end of said series of bars pivots, one of said bearing points being located adjacent an articulation point on each of said pivotally interconnected series.

4. The vacuum document feeder of claim 3 wherein said cam means are associated and turn with at least one of said synchronously driven pulleys.

5. The vacuum document feeder system of claim 1 wherein said documents are envelopes.

6. The vacuum document feeder system of claim 5 wherein there are two of said four bar mechanisms each having at least one bearing point and said support means comprises table means mounted on said two bearing points, said vacuum cup means being pivotally supported on said table, and solenoid means controlled by said cam means for cyclically pivoting said vacuum cup means.

7. The document feeder of claim 5 wherein said vacuum cup means comprises means for removing documents one at a time from a stack of documents, said means for mounting said vacuum cup means providing a pivoting motion toward and away from documents at the end of said stack, means for applying a vacuum to said cup means near one end of said crescent-shaped coupler curve as it reaches said stack, means for withdrawing said vacuumized cup means from the end of said stack, whereby said vacuum cup means lifts the document at the end of said stack, said four bar mechanism moving said vacuumized cup means to the document transport means near the other end of said crescent-shaped coupler curve, means for releasing said vacuum at said nip, whereby said vacuum cup means releases said document, and means for backing said vacuum cup means away from said document after said document is placed into said nip at said document transport means.

8. The document feeder of claim 7, wherein said means for delivering vertically oriented documents to said pick-up location comprises feeder means to move said stack in a direction towards said vacuum cup means whereby the front envelope in said stack maintains a substantially constant plane.

9. The document feeder of claim 8 wherein said feeder means comprises a back stop having an inclined surface relative to the vertical whereby envelopes in said stack resting against said back stop have their bottom edges forward of their top edges and at least one endless belt below said envelopes has a saw tooth profile to keep the bottom edge of said envelopes from sliding in a forward or reverse direction along the surface of said belt.

10. The document feeder of claim 9 and further comprising a ridge between the front of said stack and said vacuum cup means said ridge causing said envelopes to be compressed at their lower edges thus rendering reliable separation.

* * * * *